US006112331A

United States Patent [19]

Horn

[11] Patent Number: 6,112,331

[45] Date of Patent: Sep. 5, 2000

[54] LIFTING FINGERS GUARD

[76] Inventor: Vernon W. Horn, 9825 S. Charles, Chicago, Ill. 60643

[21] Appl. No.: 09/368,091

[22] Filed: Aug. 3, 1999

[51] Int. Cl.[7] ..... A41D 19/00

[52] U.S. Cl. ..... 2/163; 2/21; 294/25

[58] Field of Search ..... 2/20, 21, 17, 160, 2/161.5, 161.6, 161.8, 163, 910; 294/25, 26; 473/59, 60, 61; 132/2, 213; 401/7; 602/22

[56] References Cited

U.S. PATENT DOCUMENTS

| | | | |
|---|---|---|---|
| 1,887,278 | 11/1932 | Auster . | |
| 2,769,179 | 11/1956 | Love | 2/21 |
| 2,881,022 | 4/1959 | Brust | 2/21 |
| 3,038,723 | 6/1962 | Bergendorf | 2/21 |
| 3,344,436 | 10/1967 | Stubbs . | |
| 3,398,951 | 8/1968 | Disko | 2/21 |
| 3,606,614 | 9/1971 | Dimitroff . | |
| 4,531,241 | 7/1985 | Berger . | |
| 4,651,350 | 3/1987 | Dawiedczyk . | |
| 5,131,095 | 7/1992 | D'Amato | 2/21 |
| 5,479,660 | 1/1996 | Najac . | |
| 5,487,188 | 1/1996 | Micheloni . | |
| 5,803,821 | 8/1998 | Lupinacci | 473/205 |

*Primary Examiner*—John J. Calvert
*Assistant Examiner*—Katherine Moran
*Attorney, Agent, or Firm*—Don Moyer

[57] ABSTRACT

The guard positions plates at the palm side of the two middle fingers and at a portion of the palm adjacent to the middle fingers thus distributing the weight of an object being lifted over the area of the plates in order to reduce pressure which would otherwise be present on smaller areas of the fingers and palm, without interfering with the remaining fingers which provide control of the lifted object.

4 Claims, 1 Drawing Sheet

LIFTING FINGERS GUARD

BACKGROUND OF THE INVENTION

The lifting fingers guard positions plates along the palm side of the two middle fingers and along the portion of the palm adjacent to the two middle fingers, while leaving remaining fingers free, so that the plates distribute the weight of objects being lifted over the area of the plates thus reducing the pressure which otherwise would make lifting difficult.

The invention is based on two discoveries. The first discovery is that plates can be positioned at the two middle fingers and a portion of the palm adjacent to the two middle fingers so that the weight of objects being lifted is distributed over the area of plates making it easier to lift objects because the pressure on smaller areas of the fingers and palm is greatly reduced. The second discovery is that plates should be only positioned on the two middle fingers and not the other fingers because the mobility of fingers other than the middle two fingers provide control of the object being lifted and must not be interfered with.

Various guards worn on all or part of a hand are shown in prior art; for example, by Auster in U.S. Pat. No. 1,887,278, by Stubbs in U.S. Pat. No. 3,344,436, by Dimitroff in U.S. Pat. No. 3,606,614, by Berger in U.S. Pat. No. 4,531,241, by Dawiedczyk in U.S. Pat. No. 4,651,350, by Najac in U.S. Pat. No. 5,479,660, and by Micheloni in U.S. Pat. No. 5,487,188. None of these—and no combination of these—suggests plates positioned just under the two middle fingers and on a portion of the palm adjacent to the two middle fingers which would distribute the weight of an object being lifted over the area of the plates.

SUMMARY OF THE INVENTION

One form of this lifting fingers guard comprises a ring finger plate, the ring finger plate being positioned at a ring finger palm side; a palm plate connected to the ring finger plate; and a middle finger plate connected to the palm plate, the middle finger plate being positioned at a middle finger palm side, the middle finger plate, the palm plate, and the ring finger plate not interfering with motions of remaining fingers.

Alternate forms and objects of the invention will be comprehended in the drawings and description, which will make other alternate forms and objects obvious hereafter to persons skilled in the art.

DESCRIPTION OF THE PREFERRED EMBODIMENTS

Figure 1:
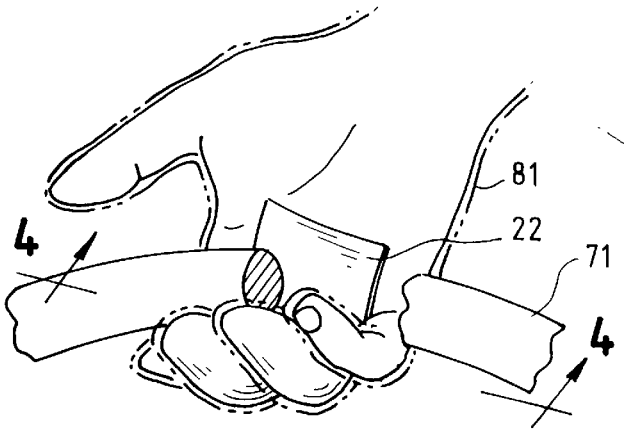
FIG. 1 shows an object being lifted with the lifting fingers guard in place.

One form of the lifting fingers guard comprises a middle finger sleeve 11 and a ring finger sleeve 12 into which a person's middle finger 91 and ring finger 92 respectively can be placed. The sleeves are made of a durable material such as leather. On the lifting side—that is, the palm side—the sleeves have pocket forming layers, 21 and 41 respectively which form a middle pocket and a ring pocket respectively, also of a durable material. A middle finger plate 31 and a ring finger plate 32, are inserted respectively in the middle pocket and the ring pocket formed by the pocket forming layers.

The middle finger sleeve 11 and the ring finger sleeve 12 are connected to a palm pad 22 which has a palm pocket forming layer 23 forming a palm pocket into which a palm plate 33 is inserted.

Figure 4:
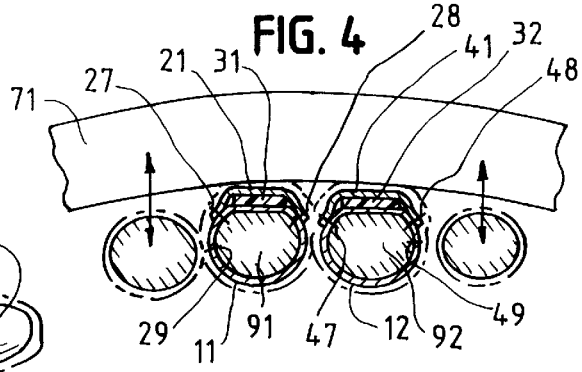
FIG. 4 shows a cross section viewed along line 4—4 in FIG. 1.
Figure 5:
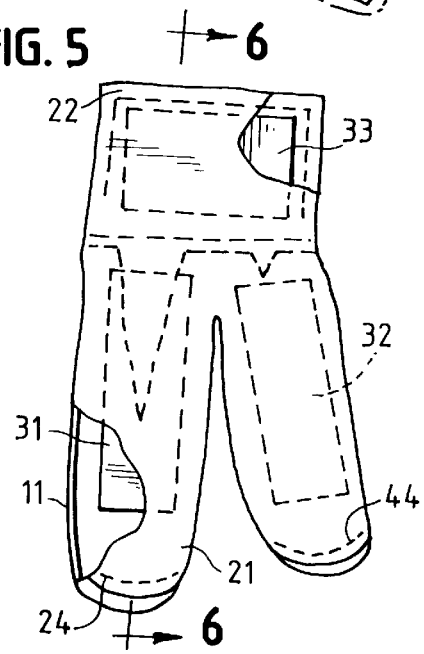
FIG. 5 shows the lifting side of the guard.
Figure 6:
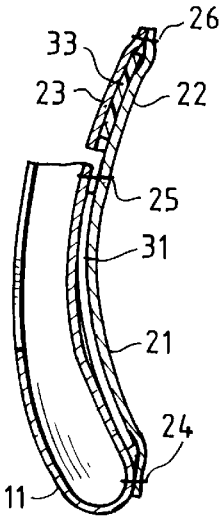
FIG. 6 shows a cross section viewed along line 6—6 in FIG. 5.

The three plates—31, 32, and 33—though bendable, are hard so that they distribute the weight of an object being lifted, such as the rod 71 shown in FIG. 1 and FIG. 4, over the area of the plates. This reduces the pressure which would otherwise be present on smaller areas of the middle finger, the ring finger, and the palm portion.

Stitching is indicated at 24, 25, 26, 27, 28, 29, 44, 47, 48, and 49 to show how the sleeves, the pocket forming layers, and the palm pocket can be put together. Other attaching means, such as adhesives, can also be used in place of stitching. The sleeves and the palm pad with the pockets could be made of various plastic materials with the elements heat welded together. Also, the plates could be heat welded onto the sleeves and the palm pad, and could be integral parts of the palm sides of the sleeves and of the palm pad.

The sleeves are shown covering the ends of the fingers, which is preferred when rough objects are lifted. In cases where the objects being lifted are not rough, the finger ends can be left off. The guard can be worn under a light glove, which does not interfere with motions of the other fingers, as indicated by 81.

Figure 2:
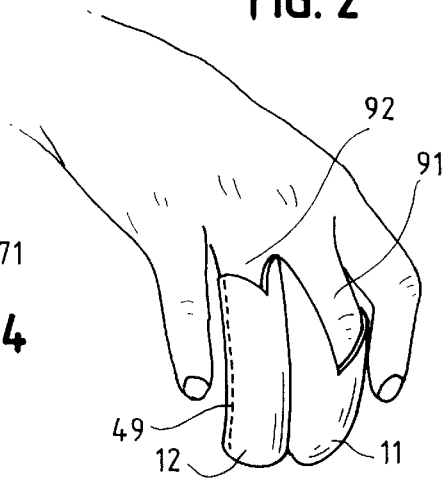
FIG. 2 shows the guard seen from above a hand.
Figure 3:
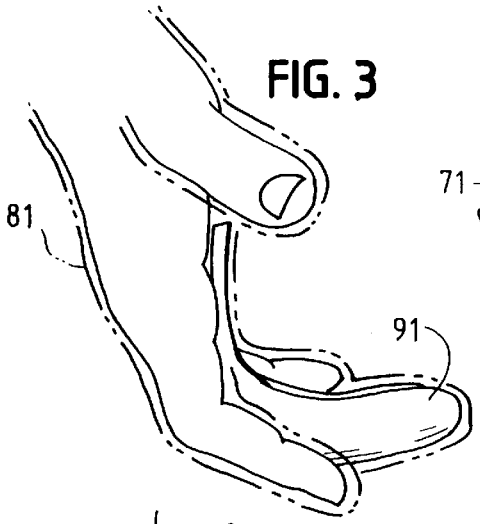
FIG. 3 shows the guard seen from beside a hand.
Figure 7:
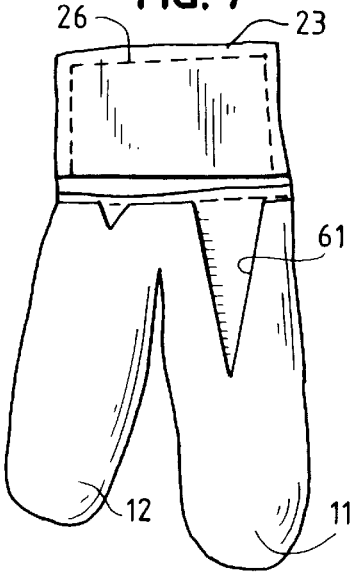
FIG. 7 shows the non-lifting side of the guard.

In FIG. 7 a deep notch 61 is shown cut into the non-lifting side of the middle finger sleeve. This allows for more free movement of the middle finger knuckle as shown in FIG. 2. Since finger sizes vary this notch, and possibly a notch on the ring finger sleeve, can be custom made.

Many alternate forms of the lifting fingers guard are possible which are consistent with the invention and with the two discoveries which are the basis of the invention. Thus alternate forms must have a middle finger plate, a ring finger plate, and a palm plate positioned on the lifting sides—that is palm sides—of the middle finger and the ring finger and a portion of the palm adjacent to these fingers and must not interfere with the remaining fingers.

The function of the sleeves and of the palm pad is to position the middle finger plate, the ring finger plate, and the palm plate on at the palm side of the fingers and palm portion. A middle finger plate connected to a palm plate and a ring finger plate connected to the palm plate could be positioned at the lifting sides of the middle fingers by various alternate mechanisms.

For example, these connected plates could be positioned by use of adhesive. They could be worn under a light glove which does not interfere with the other fingers and thumb. Alternatively a ring which at least partially encircles a middle finger and which is attached to the middle plate can position the plates. Similarly, a ring which at least partially encircles a ring finger and is attached to the ring finger plate can position the plates. And, a first ring and a second ring at least partially encirciling respectively a middle finger and a ring finger and attached respectively to the middle finger plate and to the ring finger plate can position the plates.

Alternate forms for the plates, and other ways to position the plates will be obvious hereafter to persons skilled in the art. Therefore this invention is not limited to the particular examples shown and described here.

I claim:

1. A lifting fingers guard comprising:

a ring finger plate, the ring finger plate being positioned at a ring finger palm side when in use;

a palm plate connected to the ring finger plate; and a middle finger plate connected to the palm plate, the middle finger plate being positioned at a middle finger palm side, the middle finger plate, the palm plate, and the ring finger plate being hard to distribute held weight, the middle finger plate, the palm plate, and the ring finger plate not interfering with motions of remaining fingers when in use.

2. The device of claim 1 wherein the ring finger plate is combined with a ring finger sleeve, the middle finger plate is combined with a middle finger sleeve, the palm plate is combined with a palm pad, with the palm pad being connected to the ring finger sleeve and to the middle finger sleeve.

3. The device of claim 2 wherein the ring finger plate is combined with the ring finger sleeve by being inserted into a ring pocket on the ring finger sleeve, the middle finger plate is combined with the middle finger sleeve by being inserted into a middle pocket on the middle finger sleeve, and the palm plate is inserted into a palm pocket on the palm pad.

4. A lifting fingers guard comprising:

a ring finger sleeve positioned on a ring finger when in use;

a ring pocket on the ring finger sleeve;

a ring finger plate inserted into the ring finger pocket;

a palm pad connected to the ring finger sleeve;

a palm pocket in the palm pad;

a palm plate inserted into the palm pocket;

a middle finger sleeve connected to the palm pad and positioned on a middle finger when in use;

a middle finger pocket on the middle finger sleeve; and a middle finger plate inserted into the middle finger pocket.

* * * * *